US006176642B1

(12) United States Patent
Hinterholzer

(10) Patent No.: US 6,176,642 B1
(45) Date of Patent: Jan. 23, 2001

(54) FLAG-CARRYING GATE FOR SKIING

(76) Inventor: Hans Hinterholzer, Hvitstenveien 21, N0-1545 Hvitsten (NO)

( * ) Notice: Under 35 U.S.C. 154(b), the term of this patent shall be extended for 0 days.

(21) Appl. No.: 09/308,421

(22) PCT Filed: Sep. 3, 1997

(86) PCT No.: PCT/AT97/00192

§ 371 Date: May 18, 1999

§ 102(e) Date: May 18, 1999

(87) PCT Pub. No.: WO98/22190

PCT Pub. Date: May 28, 1998

(30) Foreign Application Priority Data

Nov. 20, 1996 (AU) ..... 2025/96

(51) Int. Cl.[7] ..... E01F 9/00; G09F 15/00; G09F 17/00

(52) U.S. Cl. ..... 404/10; 40/608; 116/173

(58) Field of Search ..... 404/10; 280/820; 40/606, 607, 608; 256/1; 116/173; 248/218.4, 219.1, 562, 610

(56) References Cited

U.S. PATENT DOCUMENTS 3,691,677 * 9/1972 Blaising ..... 40/617
4,105,190 * 8/1978 Curtis ..... 256/1
4,221,407 * 9/1980 Steimle ..... 285/236
4,235,034 * 11/1980 Black ..... 40/607
4,880,195 * 11/1989 Lepley ..... 248/219.4
5,024,551 6/1991 Hinterholzer .
5,388,794 * 2/1995 Wolff ..... 248/219.4
5,394,927 * 3/1995 Huebner ..... 160/327

FOREIGN PATENT DOCUMENTS 0 702 985 3/1996 (EP) .
6-269532 * 9/1994 (JP) ..... 404/10
WO 89/07477 8/1989 (WO) .

* cited by examiner

*Primary Examiner*—Eileen D. Lillis
*Assistant Examiner*—Gary S. Hartmann
(74) *Attorney, Agent, or Firm*—Collard & Roe, P.C.

(57) ABSTRACT

A slalom gate comprises a pair of upright gate posts, a flag panel having two side edges and an upper edge, the side edges defining sleeve-like elements receiving the gate posts whereby the flat panel is held between the gate posts, two clamping devices affixing the upper edge of the flag to the gate posts, at least one of the clamping devices being separate from the flag panel, and an elongated rubber-elastic traction member connecting the flag panel at least at one of the gate posts to the separate clamping device.

10 Claims, 2 Drawing Sheets

FLAG-CARRYING GATE FOR SKIING

BACKGROUND OF THE INVENTION

The invention relates to a flag-carrying gate for skiing, with a flag panel held between two gate posts and having at opposite side edges two sleeve-like elements for receiving the gate posts and two upper clamping devices for the gate posts.

In a known flag-carrying gate of this type (EP 0 702 985 A1), the sleeve-like element receiving what is the outer gate post relative to the ski track to be limited by the gate is upwardly extended to provide a hose section which is closed at the end, and the upper end of the gate post received in this sleeve-like element projects into it. This closed hose section in a simple manner prevents the flag panel from being upwardly displaced along the outer gate post if the skier runs against the inner gate post on a ski track limited by such flag-carrying gates, which inner gate post usually has a pivotal joint enabling the inner gate to tilt about the joint downwardly and outwardly. Since an upper clamping sleeve axially immovably affixes the flag panel to the inner gate post, the downwardly pivoting inner gate post exerts a tension force on the flag panel, which is transmitted by the closed hose section to the outer gate post without having to fear a downward gliding of the flag panel along the outer gate post. Therefore, the flag panel maintains its axial position on both gate posts. The only requirement is to secure the closed hose section against displacement from the upper end of the outer gate post when the inner gate post resiliently rebounds into its original position. For this purpose, a rubber band is secured to this hose section and looped around the hose section and the outer gate post. While the friction joint produced between the hose section and the outer gate post prevents an undesired gliding of the hose section off the upper end of the outer gate post, drawing the flag panel off the outer gate post is assured if the flag panel is taken along by the skier between the gate posts. While these known flag-carrying gates have been successfully used, the possible deviating motion of the inner gate post caused by a skier running into it is limited because of the tensioned connection of the two gate posts by the flag panel, even if the flag material is elastic.

To make a maximum deviating motion of the inner one of two gate posts of a flag-carrying gate possible, it is also known (WO 89/07477 A1) to affix the flag panel to the inner, tiltable gate post by a sleeve through which the inner gate post extends while it is connected to the outer, non-pivotal gate post by a rubber traction member which extends within the outer gate post down to the lower end thereof to obtain a sufficient length for a free tilting of the inner gate post. However, this construction has the disadvantage that the rubber traction member extending inside the outer gate post requires a special gate post structure, and that the flag panel can be drawn off only the inner gate post by a skier taking it along. In addition, the outer gate post must be oriented relative to the inner gate post because of the recesses for the rubber traction member, and one must do with a reduced width of the flag panel because it has no sleeve-like element receiving the outer gate post.

SUMMARY OF THE INVENTION

It is therefore the object of the invention to configurate a flag-carrying gate of the first-described type in a simple construction so that it assures a substantially unhindered deviating motion of the inner gate post when it is hit by a skier without having to fear a displacement of the flag panel when the gate post resiliently rebounds into its original position. Furthermore, the use of the flag-carrying gate should be independent of the gate post structure.

The invention accomplishes this object by connecting the flag panel by means of a rubber-elastic traction member with a clamping device which is separate from the flag panel at least at one of the gate posts.

The rubber-elastic traction member between the clamping device and the flag panel at least at one gate post enables the flag panel to glide downwardly along this gate post against the resilient force of the rubber-elastic traction member. Since the tilting of the inner gate post and its resultant inclination of the two gate posts towards the flag panel exerts a downwardly directed force component on the flag panel, the flag panel glides downwardly against the retaining force of the rubber-elastic traction member at least along one gate post, which considerably increases the pivoting range of the two gate posts, it being assumed that generally the inner gate post will be tilted downwardly and outwardly so that, while the distance between the upper ends of the gate posts will be substantially increased, it is not increased in the center of the gate posts into which the flag panel is pulled down. Therefore, the distance between the inner and outer gate posts determined by the width of the flag panel permits a sufficient pivoting motion of the inner gate post as the flag panel glides down along at least one of the gate posts to satisfy all safety requirements. The return force of the rubber-elastic traction member assures the return of the flag panel to its initial position, which is determined by the clamping device which is engaged by the rubber-elastic traction member. Since the two gate posts are received in the sleeve-like elements at the side edges of the flag panel in the usual manner and the flag panel is held in position by the two upper clamping devices, such a flag-carrying gate is independent of the structure of the gate posts.

If the rubber-elastic traction member is guided along the upper edge of the flag panel, a sufficient extension length of the rubber-elastic traction member is assured in a simple manner because the length of the rubber-elastic traction member may be matched to the width of the flag panel. It is only necessary that the rubber-elastic traction member be freely extensible relative to the flag panel in its guide along the upper flag panel edge. A particularly simple construction is obtained in this connection if the rubber-elastic traction member guided along the upper flag panel edge engages the clamping devices which are separate from the flag panel at both gate posts because, in this case, the flag panel may be pulled along both gate posts away from the separate clamping devices. Because of the resilient return forces of the rubber-elastic traction member, the flag panel will be pulled up to its initial position immediately below the clamping devices when the gate posts assume their initial position after the tilting motion.

Since different flag panels may be used, it is preferred to connect the upper edge of the flag panel with the rubber-elastic traction member detachably to the rest of the flag panel so that any flag panel portion to be used may be connected to an upper edge which has not only the rubber-elastic traction member but also the two clamping devices for the two gate posts. This separation of the flag panel into a flag panel portion and an affixing unit for the gate posts makes a simple holding of different flag panels, which may also carry advertisements, possible.

A great variety of clamping devices may be used, their only requirement being to prevent their displacement on the gate posts, and the concomitant downward displacement of the flag panel, when the gate posts are pivoted towards each other when hit, while permitting the clamping devices to be pulled upwardly when the skier is hung up on the flag panel. These requirements may be met advantageously by a frictional clamping connection if the clamping forces are limited, as is the case, for example, with a clamping device consisting of a circumferentially open and elastically expandable clamping sleeve, which has the additional advantage that it may be snap-mounted on the gate post in a radial direction. In another embodiment, at least one clamping device is a rubber-elastic collar which may be pulled over the guide post. Since a simple mounting of the clamping devices on the gate posts is of decisive significance for the simple handling of the flag-carrying gates, the collar may be comprised of an inelastic sleeve enveloping the gate post with a clearance therebetween and at least one rubber-elastic ring encircling the inelastic sleeve and secured thereto against axial displacement. The inelastic sleeve operates as a guide which may be readily pulled over the gate post and the rubber-elastic ring is suitably widened because it cannot be displaced from the sleeve since it is axially secured. To facilitate the exchangeability of such a rubber-elastic ring, a loose rubber-elastic ring should be provided. For such a loose rubber-elastic ring, the inelastic sleeve may have at least one safety ring preventing the rubber-elastic ring from axially gliding off. This safety ring may simply be constituted by an annular bead of the sleeve, for example a sewed-on non-woven fabric strip.

As has already been indicated, flag panels are utilized for advertisements. To enable the flag panels to carry different advertising messages, the flag panels may have connection parts for detachably receiving planar advertising carriers, which thus may be affixed to the connection parts of the flags. Such connection parts may be constituted by zippers, snap fasteners, and also particularly Velcro fasteners.

Another flag panel freely displaceably carried by the gate posts may be detachably affixed to the lower edge of the flag panel, without in any way interfering with its functioning with respect to the free pivoting of the gate posts. Advantageously, Velcro fastenings are used for this purpose.

The drawings illustrate the subject matter of the invention by way of example.

DETAILED DESCRIPTION

Figure 1:
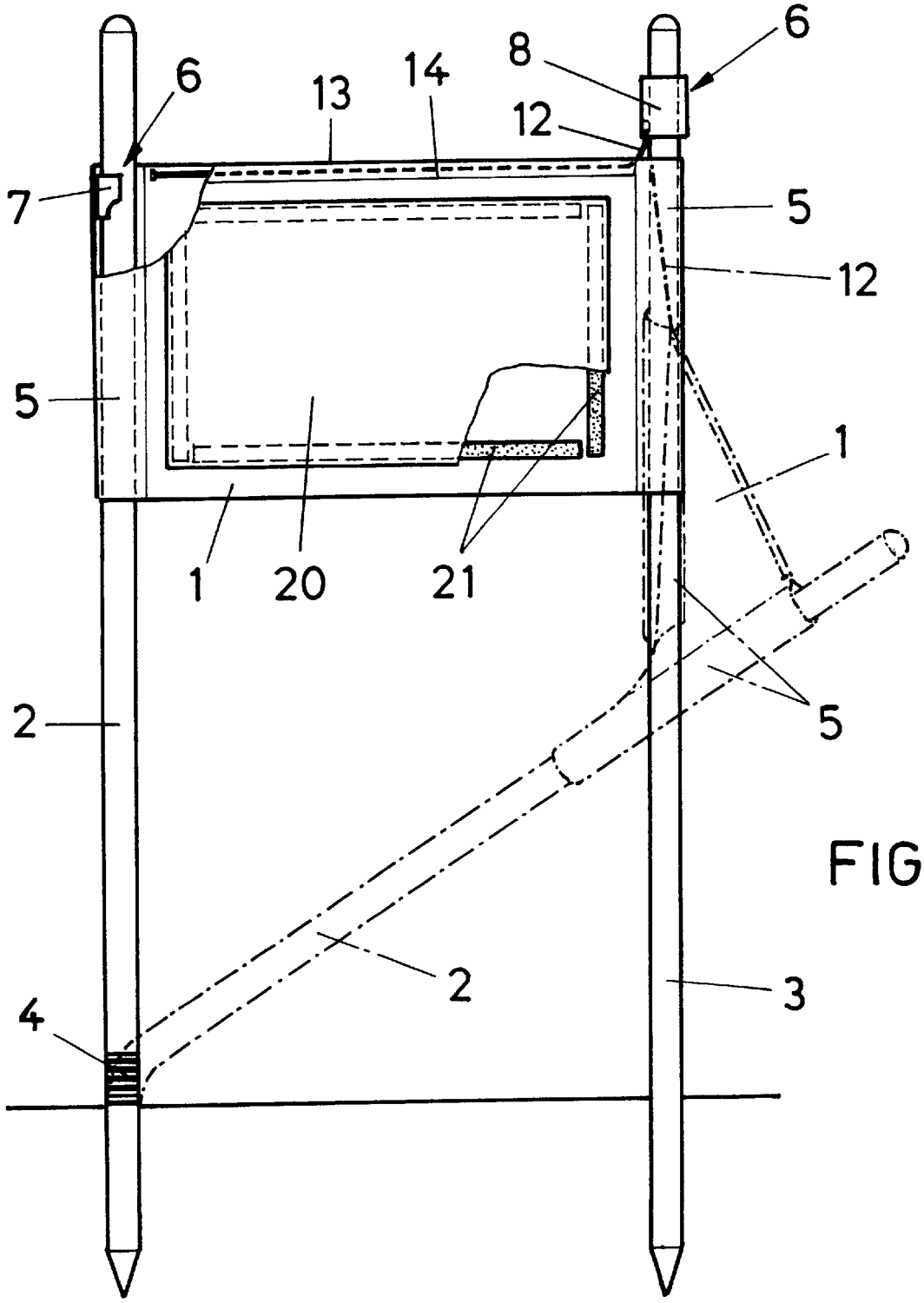
FIG. 1 shows a flag-carrying gate for skiing according to the invention, in a simplified view, with parts broken away.

The flag-carrying gate according to the illustrated embodiments comprises flag panel 1 between two gate posts 2 and 3, the inner gate post 2 with respect to the ski track having a pivotal joint 4, which permits the gate post to be tilted when hit by a skier. Since generally only inner gate post 2 will be hit by a skier, outer gate post 3 may be without a pivotal joint. However, it is possible, of course, to provide a pivotal joint at outer gate post 3, too.

Figure 2:
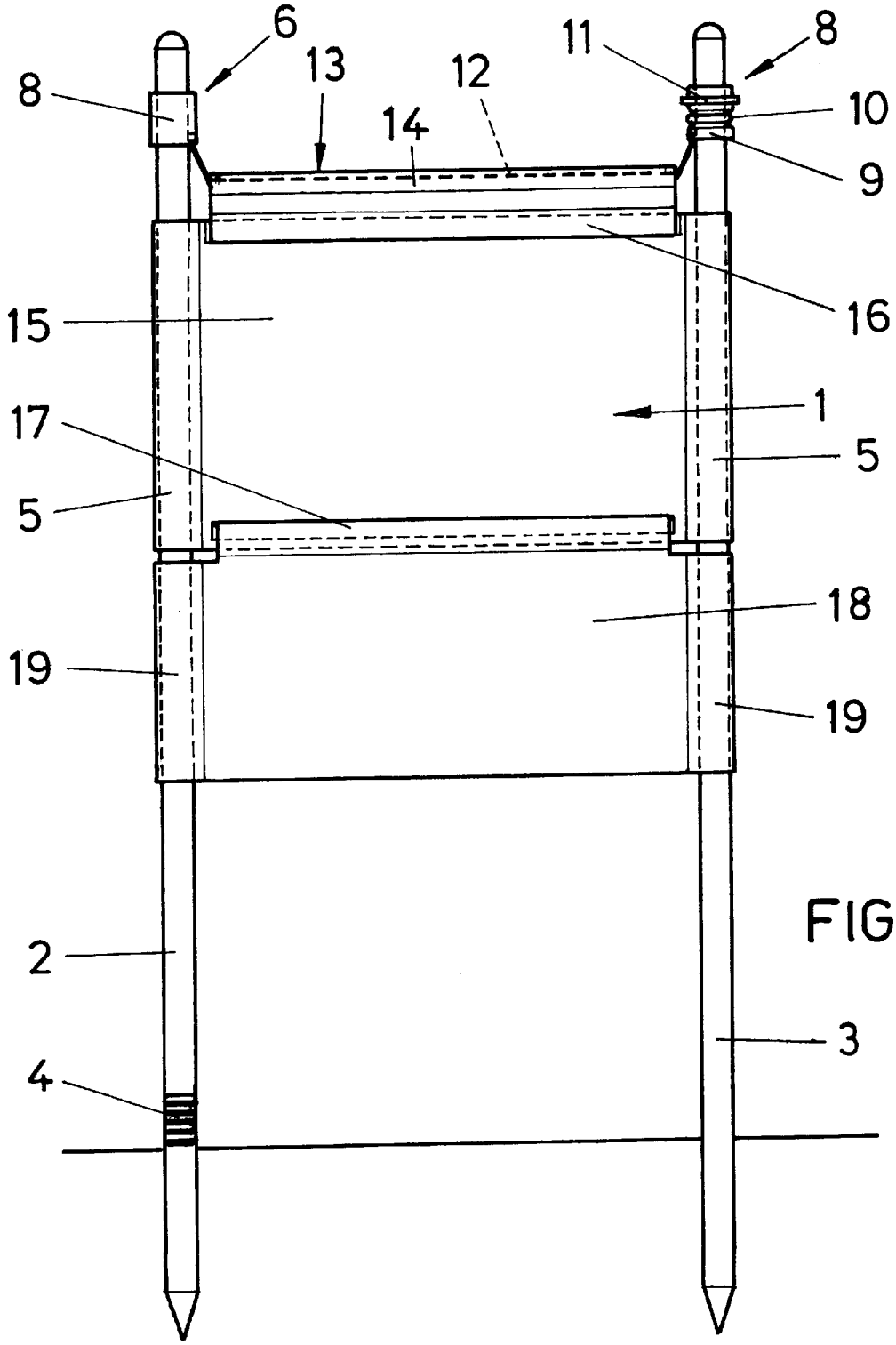
FIG. 2 is a like view of another embodiment of such a flag-carrying gate.

Sleeve-like elements 5 are provided at the opposite side edges of substantially rectangular flag panel 1 for receiving gate posts 2, 3. These sleeve-like elements 5 are produced by folding over the side edges of the flag panel and sewing them to the flag panel. Since sleeve-like elements 5 define a clearance with gate posts 2 and 3, it is necessary to fix flag panel 1 axially on gate posts 2 and 3. For this purpose, clamping devices are frictionally connected to gate posts 2, 3. Clamping devices 6 may be constituted, for example, by clamping sleeves 7, which are circumferentially open and whose facing longitudinal edges are elastically expandable so that clamping sleeve 7 may be snapped onto the gate post in a radial direction. This radial mounting, which requires a suitably larger diameter of sleeve-like element 5 at least in the range of clamping sleeve 7, facilitates the fixing of the flag panel on the gate posts since in this case clamping sleeve 7 need not be pulled over the upper end of the gate post of a respective gate post. However, the clamping device may also be constituted by a rubber-elastic collar 8 which is pulled from above onto gate posts 2 or 3. Mounting of rubber collar 8 may be facilitated if an inelastic sleeve 9 encircling the gate post is provided with rubber-elastic ring 10, as is shown in FIG. 2. Therefore, sleeve 9 may be pulled over the upper end of the gate post without requiring the manual expansion of rubber-elastic ring 10. Safety ring 11 preventing axial gliding of rubber-elastic ring 10 may be constituted, for example, by a non-woven fabric strip sewn around sleeve 9. It need not be mentioned specifically that by arranging two safety rings 11 at both sides of rubber-elastic ring 10, this rubber-elastic ring 10 cannot glide up or down on the sleeve. Instead of safety ring 11, rubber-elastic ring 10 could be at least locally fixed to sleeve 9, for instance by a seam.

In the embodiment of FIG. 1, clamping device 6 for gate post 2 is an integral component of sleeve-like element 5 at an upper end thereof while clamping device for the other gate post 3 is a component separate from flag panel 1 and is connected to flag panel 1 by rubber-elastic traction member 12. This rubber-elastic traction member 12 is guided within seam 14 of flag 1 along upper edge 13 and engages clamping sleeve 7 or flag panel 1 in the range of the clamping sleeve. When guide post 2 is hit by a skier and is tilted downwardly and outwardly, flag panel 1, which is taken along with guide post 2, can glide downwardly along gate post 3 against the spring force of rubber-elastic traction member 12, as illustrated in phantom lines. The possibility of the displacement of flag panel 1 along gate post 3 enlarges the tilting range of the gate post without interfering with the predetermined height of the flag panel in the initial position of gate posts 2 and 3 because, when the titled gate post 2 is returned to its initial position by the return force of rubber-elastic traction member 12, flag panel 1 will also be pulled up along gate post 3 into its initial position. The available enlarged tilting range of inner gate post 2 considerably diminishes the danger of injury to the skier hitting the gate post. To prevent the skier from being caught in a loop formed by flag panel 1 between gate posts 2 and 3 as the skier passes through the gate, at least one of the two clamping devices 6 must be glidable upwardly over the upper end of the gate post 2 and/or 3 under the force of the skier impinging on flag panel 1. This requirement may be readily met by a suitable limitation of the clamping force.

FIG. 2 shows an embodiment of a flag-carrying gate with separate clamping devices 6 for both gate posts 2 and 3, wherein a rubber-elastic traction member 12 is arranged between these clamping devices 6 and flag panel 1 freely displaceably mounted on gate posts 2 and 3. Each of the two clamping devices 6 may be connected by a rubber-elastic traction member 12 with flag panel 1. However, a particularly simple construction is obtained by using a common rubber-elastic traction member 12, which displaceably passes through hollow seam 14 of flag panel 1, as indicated in FIG. 2. This assures the displaceability of flag panel 1 relative to gate posts 2 and 3, which additionally enlarges the free tilting range of tiltable gate post 2. The return of flag panel 1 into its initial position determined by clamping devices 6 is assured by the return force of rubber-elastic traction member 12 in an analogous manner. It must not be emphasized that in this case, too, at least one of the two clamping devices 6 must be upwardly glidable to be removed from its gate post by the skier to avoid injury to the skier who may otherwise be caught in a tensioned flag panel extending between gate posts 2 and 3.

As can be seen in FIG. 2, upper edge 13 of flag panel 1, with clamping devices 6 and rubber-elastic traction member 12, may constitute a fixing unit separate from the remaining portion 15 of the flag panel so that different flag panel portions 15 may be connected to the fixing unit. For this purpose, Velcro fastening 17 may be provided between upper edge strip 13 and remaining flag panel portion 15, their cooperating Velcro strips being respectively associated with flag panel portion 15 and upper edge strip 13. Additionally, a further flag panel portion 18 may be attached by Velcro fastening 17 to the lower edge of flag panel 1 and is displaceably mounted on gate posts 2 and 3 by sleeve-like elements 19, like flag panel 1. This further flag panel portion 18 is displaced downwardly along gate posts 2 and 3 when they are tilted.

To enable flag panel 1 to carry different planar advertising messages 20 in a simple manner, flag panel 1 may have suitable connection parts 21 for detachably receiving planar advertising messages 20, as has been indicated in FIG. 1. Connection parts 21 may also be Velcro fasteners, but zippers or snap fasteners may also be used.

Of course, the invention is not limited to the illustrated embodiments. For example, clamping devices 6 may be hose sections closed at one end and pulled over the upper ends of the gate posts, a rubber band or the like holding those hose sections on gate posts 2 and 3 to prevent them from unintentionally gliding off the gate posts. However, such clamping devices are recommended only if a given distance of flag panel 1 from the upper ends of gate posts 2, 3 is predetermined. It would also be possible for the rubber-elastic traction member to have loops at the ends thereof to form the clamping devices.

What is claimed is:

1. A flag-carrying gate for skiing, which comprises (a) a pair of upright gate posts, (b) a flag panel having two side edges and an upper edge, the side edges defining sleeve-like elements receiving the gate posts whereby the flag panel is held between the gate posts, (c) two clamping devices affixing the upper edge of the flag panel to the gate posts, at least one of the clamping devices being separate from the flag panel, and (d) an elongated rubber-elastic traction member connecting the flag panel at least at one of the gate posts to the separate clamping device.

2. The flag-carrying gate of claim 1, wherein the traction member is guided along the upper edge of the flag panel.

3. The flag-carrying gate of claim 2, wherein both clamping devices are separate from the flag panel and the traction member engages both clamping devices.

4. The flag-carrying gate of claim 2, wherein the upper edge is detachably connected to the flag panel.

5. The flag-carrying gate of claim 1, wherein at least one of the clamping devices is a circumferentially open and elastically expandable clamping sleeve.

6. The flag-carrying gate of claim 1, wherein at least one of the clamping devices is a rubber-elastic collar.

7. The flag-carrying gate of claim 6, wherein the collar is comprised of an inelastic sleeve enveloping a respective one of the gate posts with a clearance therebetween and a rubber-elastic ring, the ring encircling the inelastic sleeve and secured to the inelastic sleeve against axial displacement.

8. The flag-carrying gate of claim 7, further comprising a safety ring on the inelastic sleeve for securing the rubber-elastic ring from axially gliding off the inelastic sleeve.

9. The flag-carrying gate of claim 1, wherein the flag carries connection parts for detachably connecting planar advertising messages to the flag panel.

10. The flag-carrying gate of claim 1, further comprising another flag panel freely displaceably carried by the two gate posts and detachably adjoining a lower edge of the first-named flag panel.

* * * * *